United States Patent [19]

Bublik et al.

[11] Patent Number: 4,861,349

[45] Date of Patent: Aug. 29, 1989

[54] GRINDING METHOD

[75] Inventors: Eugene P. Bublik, Buckinghamshire, England; Zbigniew Sartowski, Budapest, Hungary

[73] Assignee: Allied Colloids Ltd., England

[21] Appl. No.: 202,893

[22] Filed: Jun. 6, 1988

[30] Foreign Application Priority Data

Jun. 5, 1987 [GB] United Kingdom ..... 8713205

[51] Int. Cl.[4] ..... B24D 18/00

[52] U.S. Cl. ..... 51/293; 51/298

[58] Field of Search ..... 51/293, 298

[56] References Cited

U.S. PATENT DOCUMENTS

| | | | |
|---|---|---|---|
| 3,670,467 | 6/1972 | Walker | 51/293 |
| 3,864,101 | 2/1975 | Charvat | 51/293 |
| 3,950,149 | 4/1976 | Fukuda | 51/293 |
| 4,369,046 | 1/1983 | Bruschek et al. | 51/293 |
| 4,575,384 | 3/1986 | Licht et al. | 51/293 |
| 4,761,163 | 8/1988 | Messere | 51/293 |

FOREIGN PATENT DOCUMENTS

| | | |
|---|---|---|
| 0195550 | 6/1973 | European Pat. Off. . |

*Primary Examiner*—A. Lionel Clingman
*Assistant Examiner*—Willie J. Thompson
*Attorney, Agent, or Firm*—Ostrolenk, Faber, Gerb & Soffen

[57] ABSTRACT

Solid material is ground in a grinding mill and caking of the ground particles is substantially eliminated by including particulate water absorbent polymeric material in the mill.

12 Claims, No Drawings

GRINDING METHOD

Wet particulate material that has a particulate content and a water content such that it is a sticky mass or a slurry can be rendered more friable by the addition of particles of absorbent polymeric material, as described in EP No. 195550. In this process the absorbent polymeric material absorbs sufficient of the free water in the sticky mass or slurry to allow the mass to become more friable, but the total amount of water in the mass remains unchanged. Also a significant amount of water remains free in the mass since an equilibrium is established between the water that is in the free state in the mass and the water that has been absorbed into the absorbent polymer. This residual free water can, in some instances, be such that the mass remains slightly sticky despite the incorporation of an amount of absorbent polymer that, theoretically, should be sufficient to give a very friable mixture.

It is well known that pigments and other articulate materials can be ground wet or dry. Wet grinding involves contamination of the polymer material with water and requires provision of a water supply. Dry grinding is therefore often preferred. The feed for dry grinding is always a very friable, apparently dry, particulate material. Unfortunately many such materials cannot be dry ground. This is because the shear and other forces applied during the grinding tends to cause the particles that are formed during the grinding to cake in the grinding apparatus. If the caking is on the grinding members, e.g., the balls in a ball mill, this greatly reduces grinding efficiency. If the caking is on the walls of the apparatus and, especially, on the walls of the outlet ducts then the caking is liable to reduce grinding efficiency and to cause blockage.

It is known that even very low amounts of water in the particulate material can promote this caking. Sometimes as little as 1% free water can cause serious caking and very few free flowing, friable materials can be dry ground if their free water content is above 5%.

Accordingly polymeric material that is to be dry ground always has to be pre-dried very thoroughly and this is inconvenient and energy intensive. Even with this thorough pre-drying only relatively few particulate materials can be satisfactorily dry ground.

In the specification we use the term "free water" to cover water that is free between the particles or that is physically bound on the surfaces of the particles or (when appropriate) is absorbed into an absorbent polymer, but we do not include chemically bound water such as the water of hydration in inorganic hydrates.

It would be desirable to be able to reduce or eliminate the problem of caking in dry grinding processes. In particular it would be desirable to reduce the amount of pre-drying that is necessary and it would be desirable to permit satisfactory dry grinding of materials that previously were incapable of being dry ground, even with optimum pre-drying.

In the invention a solid material is dry ground in a grinding mill to form ground particles and caking of the ground particles material is substantially prevented by including in the mill particulate water absorbent polymeric material that remains non-sticky throughout the process.

The invention permits satisfactory dry grinding of particulate material in the presence of free water amounts that would, prior to the invention, inevitably have caused serious caking and it permits satisfactory dry grinding of particulate materials that, prior to the invention, would not have been capable of being dry ground.

It is very surprising that the presence of the water absorbent polymeric material does not interfere deleteriously with the dry grinding since it might have been thought that the presence of the polymer would, itself, promote caking. Additionally it is very surprising that the water absorbent polymeric material has the observed effect even though it is subjected to high shear and grinding forces during the process.

The solid material that is dry ground in the process can be any of the materials that are conventionally dry ground at present, for instance the various inorganic and/or pigmentary materials that are conventionally dry ground. However because of the reduction in caking it is also now possible to dry grind materials, generally inorganic and/or pigmentary materials, that would previously have had to be wet ground.

The solid material that is to be dry ground by being fed to a grinding mill will be fed to the grinding mill in the form of a particulate friable solid that normally has a relatively low free water content, typically below 30% and generally below 25%. Preferably the amount of free water is below 20% and often below 15%. Whereas it was always necessary, prior to the invention, for the free water content to be as low as possible and generally below 5% this is no longer essential and so it is no longer necessary to dry the solid material so thoroughly before the process. Generally therefore the free water content is above 5% but it can be as low as, for instance, 2% or lower.

The grinding mill can be a fixed path mill, such as a hammer mill, roller mill or jet microniser, or it can be a tumbling mill, such as a rod mill, a ball mill or an Aerofall mill. The invention is of particular value when the grinding is by a ball mill or by a high speed roller grinder.

The dry grinding can be such as to reduce the solid material from an average particle size of above 1 mm, generally above 1 cm, often above 10 cm, to a maximum size of below 500 μm, often below 200 μm. In general the starting and final particle sizes can be the conventional sizes for dry grinding techniques.

The absorbent polymeric material can be added to the solid material before the solid material is introduced into the mill but preferably it is mixed with the solid material either in the mill or as the material enters the mill. If the process is conducted in such a way that there is sufficient time for the absorbent material to absorb sufficient free water (for instance if the absorbent material is mixed with the solid before entry to the mill) then the absorbent material can have a relatively large dry particle size, for instance with substantially all the particles below 500 μm (preferably below 250 μm) but with at least 50% by weight of the particles above 50 μm. Generally however it is preferred for substantially all (at least 90% by weight) of the particles to be below 200 μm and often below 100μm. For best results at least 90% by weight of the particles are generally below 50 μm.

The polymeric material may be added in the form of dry powder. This may have been made by comminuting polymer gel made by bulk gel polymerisation or by comminuting beads made by reverse phase polymerisation, or it may have been made by reverse phase suspension polymerisation to the desired size followed by drying and separation from the organic liquid in which the polymerisation was conducted.

It is however preferred, especially when the particle size is at least 90% below 50 μm, for the polymeric material to be provided as a dispersion in water immiscible liquid, so that this dispersion is added into the grinding mill or to the solid material before entry to the mill.

One very satisfactory form of dispersion is a dispersion obtained by dispersing pre-formed dry polymer particles into water immiscible liquid in the presence of dispersion stabiliser. The polymer particles generally have a dry size below 50 μm, generally mainly in the range 10 to 50 μm. They may be fines obtained from the comminution of polymer gel or they may be fines from a reverse phase bead polymerisation process.

The dispersion should preferably be stable against settlement and formation of the dispersion of preformed particles in water immiscible liquid may be by mixing, accompanied by a dispersion stabiliser. Conventional stabilisers for oil-based dispersions may be used, e.g., Bentone clays, but preferably the dispersion is stabilised by mixing into it, with stirring, an oil soluble or, preferably, oil swellable polymeric thickener, generally being introduced as an aqueous emulsion. Preferred materials are described in EP No. 161926, with particular reference to example 7.

The water immiscible liquid in which the particles are dispersed is usually a hydrocarbon oil and it is sometimes desirable to include an additional surfactant, usually an oil in water surfactant, to promote spreading of the dispersion on the solid material.

Instead of dispersing pre-formed polymer fines into water immiscible liquid very satisfactory results can also be obtained when the dispersion is made by reverse phase polymerisation in the water immiscible liquid to the desired particle size of below 50 μm. In such processes the particle size is generally mainly below 20 and most preferably below 10 μm. For instance at least 90% by weight, and preferably 99% by weight, may be below 3 μm.

Reverse phase polymerisation may be conducted in conventional manner, e.g., using amphipathic stabiliser and/or emulsifier, followed by azeotropic distillation to produce a substantially dry dispersion in the water immiscible liquid.

The polymer particles normally contain below 30%, often below 20%, by weight water based on dry weight of polymer at the time of combination with the solid material and are often at or below their atmospheric equilibrium moisture content. However when the dispersion is made by reverse phase polymerisation we have found that it is sometimes desirable for the dispersion to contain, at the time of addition to the mill or the material being ground, a substantial amount of water, usually at least 30% based on the dry weight of polymer. The amount of water in the dispersion is usually below 150% and typically is in the range 60 to 120%, preferably 80 to 100%, based on the dry weight of polymer. The water in the dispersion is absorbed into the polymer particles and thus they are partially wet before use.

The amount (dry weight) of polymer in the dispersion is typically in the range 30 to 60%.

The polymeric material must remain non-sticky throughout the process. If the polymeric material is soluble then the amount of polymer, relative to the amount of free water, must be sufficiently large that the absorption of the free water by the polymer does not result in the surfaces of the polymer particles becoming sufficiently sticky that they tend to promote caking, rather than reduce caking. Preferably therefore the polymeric material is a water insoluble but water swellable material.

It can be a naturally occurring or modified naturally occurring polymeric material but preferably is a synthetic polymer and most preferably is a cross linked polymer formed from a water soluble monoethylenically unsaturated monomer or monomer blend. The monomer is generally vinyl, e.g., acrylic, but can be allyl. The degree and manner of cross linking should be such that the particles remain non-sticky even if the particles are contacted with excess water.

The polymeric material can be non-ionic, anionic or cationic. Preferred non-ionic monomers include acrylamide but others include hydroxyalkyl (meth) acrylates, for instance hydroxyethyl acrylate. Polyacrylamide has very good water-absorption characteristics and can be used.

Monomers from which cationic polymers can be produced include nitrogen-containing ethylenically unsaturated monomers. Preferred monomers include dialkylaminoalkyl -(meth)acrylamides and -(meth)acrylates and their acid addition salt and quaternary derivatives, for example dimethyl aminopropyl methacrylamide quaternised with methylchloride (MAPTAC), dimethylaminoethyl acrylate and -methacrylate and diethylaminoethyl acrylate and -methacrylate, and di(meth)allyl dialkyl ammonium compounds, for example diallyldimethyl ammonium chloride.

Monomers from which anionic polymers may be produced preferably include ethylenically unsaturated carboxylic or sulphonic acids. The preferred monomers include (meth) acrylic acid, itaconic acid, crotonic acid and 2-acrylamido-2-methyl propane sulphonic acid; acrylic acid is preferred. Anionic monomers may be present as free acid or, preferably, as a water soluble salt, for instance with ammonium or sodium or other alkali metal.

Other monomers that can be included are any of the monomers containing hydrophobic, preferably polyalkyleneoxy hydrophobic, groups as described in EP No. 0172723. Suitable amounts are generally 0.1 to 5 mole percent.

Cationic polymers that can be used are generally formed from 5 to 100 mole percent cationic monomer and 0 to 95 mole percent, preferably 50 to 90 mole percent, acrylamide.

Preferred polymers for use in the invention are anionic and are formed of 5 to 100 mole percent acrylic acid as free acid or water soluble salt, 0 to 95 mole percent acrylamide and 0 to 50 mole percent other monoethylenically unsaturated monomer, and cross linking agent. Preferably the polymer is formed of cross linked sodium polyacrylate, optionally copolymerised with acrylamide.

When the particles are to be cross linked, cross linking agent is preferably included in the monomer or monomer blend that is polymerised to form the particles. The amount of cross linking agent is generally from 10 to 10,000 ppm by weight total monomers. Usually it is at least 50 and often at least 100 ppm so as to ensure that the particles remain non-sticky. It is generally unnecessary for the amount to be above 1,000 ppm and typical amounts are 200 to 500 ppm. These amounts are the amounts by weight of methylene bis acrylamide and equivalent amounts of other cross linking agents may be used. The cross linking agent may be any of the known ionic (e.g., polyvalent metal) or covalent cross linking agents suitable for copolymerising acrylic monomers. Preferably it comprises any of the di- or polyethylenically unsaturated monomers suitable for such cross linking reactions.

The polymer particles preferably have a gel capacity for deionised water of well over 100.

Sometimes good results are achieved when the particles have a surface layer that is less swellable than the inner parts of the particles. This may be achieved by known processes; for example the desired reduced swellability of the surface layer may be obtained by cross linking the surface layer covalently or ionically.

The amount of polymer that is added is generally in the range 0.1 to 10%, by weight based on the weight of solid material. The amount is usually at least 0.2 to 0.5%. It is usually below 5%.

The following are some examples.

EXAMPLE 1

Tests were carried out using a 5 liter porcelain ball mill as follows: 1.5 kg of bauxite which had a low moisture content of 1.16% (because it had been stored in the laboratory) was treated with water to increase its moisture content to 11.6%. In this way it was rendered more closely representative of freshly mined bauxite, (moisture content 10–20%).

Using 900 gms of balls the above was ground for 30 minutes after which the mill was inspected. It was found that 6% of the bauxite being ground remained on the balls and walls.

The moisture content of the bauxite was then increased to 20% and the above grind repeated after which it was found that 100% of the bauxite remained on the balls and walls.

A dispersion in oil was formed of sodium polyacrylate cross linked with about 200 ppm methylene bis acrylamide. The dry particle size was 90% by weight below 45 μm and the dispersion had been made by dispersing dried comminuted gel particles into oil in approximately 1:1 weight ratio.

The above milling tests were then repeated with 2% dispersion (1% polymer) added to the grind when it was found that the balls and walls were absolutely clean after the 30 minute period.

EXAMPLE 2

Attempts were made to grind bentonite having a moisture content of 15.6% in a Colloplex Alpine Disintegrator (a roller grinder) which was being run at a speed of 7000 rpm. This operation was found to be impossible because the bentonite clogged the disintegrator, thus preventing any breakdown taking place.

When 4% of the dispersion of Example 1 was added to the bentonite disintegration proceeded smoothly.

EXAMPLE 3

Samples of dolomite, bentonite and kaolinite were weighed out and prepared for grinding, under laboratory conditions, in a porcelain ball mill.

Each sample was of 380 gm in weight and had an original moisture content of 0.1%. In order to simmulate more closely the condition of freshly mined mineral the moisture content of each sample was adjusted by adding water. In this way test samples of each mineral, ranging in moisture content from 1.0 to 10%, were obtained.

Tests were carried out on each sample by subjecting it to grinding for a period of five minutes. At the end of this period the mill was stopped and its contents examined. In all cases it was found that caking had taken place on the wall of the mill thus preventing efficient grinding. In many cases the caked material amounted to 50% of the mineral being ground.

A further series of tests was carried out on the same mineral samples and in the same manner, as described above. This time, however, 1.0% of the dispersion of Example 1 was added to the mineral prior to grinding. Following the five minute grinding period the mill was stopped and once again examined. In all cases the walls of the mill were found to be perfectly clean and the mineral well dispersed. These conditions were considered condusive to good grinding.

EXAMPLE 4

20 kg foundry grade bentonite is ground in a two-stage grinding process. In the first stage it is ground in an Alpina-type hammer mill and in the second stage it is ground in a disintegrator mill at 7,000 rpm.

When the bentonite has 10% moisture content and no polymer addition is made the mills operate reasonably satisfactorily to give a particle size which is 80% by weight below 100 microns.

If the moisture content is above 15%, as a result of the bentonite not having been pre-dried so thoroughly, the mills cake seriously. This can be reduced by adding a dispersion of cross linked sodium polyacrylate (as used in example 1) in an amount dependent on the amount of moisture. Thus when the free water content is 20% about 2.5% dry weight of the polymer should be added whilst when the free water content is 25% about 5.5% dry weight of the polymer should be added. In both instances the dry grinding proceeds satisfactorily despite the presence of the large amount of free water.

We claim:

1. In a process comprising a grinding step for grinding a friable particulate, solid material to form ground particles, the improvement wherein water absorbent polymeric material that remains non-sticky throughout the process is included in said grinding step to substantially prevent the ground particles from caking.

2. A process according to claim 1 wherein said friable solid material has a free water content below 30%.

3. A process according to claim 1 wherein said friable solid material has a free water content of 10 to 25%.

4. A process according to claim 1 wherein at least 90% by weight of said particulate water absorbent polymeric material is in the form of particles having a dry size below 50 μm.

5. A process according to claim 4 wherein said polymeric material is added to the mill or to the friable solid material while in the form of a dispersion of particulate polymeric material in a water immiscible liquid.

6. A process according to claim 1 wherein the polymeric material is a cross linked polymer formed from a water soluble ethylenically unsaturated monomer or monomer blend.

7. A process according to claim 6 in which said cross linked polymer is formed from 5 to 100 mole percent acrylic acid as free acid or water soluble salt and 0 to 95 mole percent acrylamide.

8. A process according to claim 1 wherein said grinding step comprises ball milling.

9. A process according to claim 4 wherein the polymeric material is a cross linked polymer formed from a water soluble ethylenically unsaturated monomer or monomer blend.

10. A process according to claim 9 in which said cross linked polymer is formed from 5 to 100 mole percent acrylic acid as free acid or water soluble salt and 0 to 95 mole percent acrylamide.

11. A process according to claim 4 wherein said friable solid material has a free water content below 30%.

12. A process according to claim 4 wherein said friable solid material has a free water content of 10 to 25%.

* * * * *